US009145753B2

(12) United States Patent
Hench

(10) Patent No.: US 9,145,753 B2
(45) Date of Patent: Sep. 29, 2015

(54) TRAPPED PRESSURE COMPENSATOR

(75) Inventor: Andrew Hench, Katy, TX (US)

(73) Assignee: OneSubsea IP UK Limited, London (GB)

( * ) Notice: Subject to any disclaimer, the term of this patent is extended or adjusted under 35 U.S.C. 154(b) by 908 days.

(21) Appl. No.: 13/224,672

(22) Filed: Sep. 2, 2011

(65) Prior Publication Data

US 2013/0056196 A1 Mar. 7, 2013

(51) Int. Cl.
*E21B 33/043* (2006.01)

(52) U.S. Cl.
CPC ..... *E21B 33/043* (2013.01); *Y10T 137/1624* (2015.04)

(58) Field of Classification Search
USPC ..... 166/338–342, 368, 244.1, 243, 212
See application file for complete search history.

(56) References Cited

U.S. PATENT DOCUMENTS 6,293,346 B1 * 9/2001 Patel ..... 166/373
6,948,715 B2 9/2005 Taylor et al.
7,096,944 B2 * 8/2006 Vargo et al. ..... 166/250.12
7,931,079 B2 4/2011 Nicholson
2005/0161262 A1 7/2005 Jamison
2006/0243435 A1 11/2006 Faul
2010/0122811 A1 * 5/2010 Maskos et al. ..... 166/244.1
2011/0168385 A1 7/2011 O'Malley

OTHER PUBLICATIONS

PCT International Search Report and Written Opinion for PCT/US2012/052856, dated Jan. 7, 2013.

* cited by examiner

*Primary Examiner* — Kenneth L Thompson
*Assistant Examiner* — Ronald Runyan
(74) *Attorney, Agent, or Firm* — Chamberlain Hrdlicka

(57) ABSTRACT

A hanger seal system includes a first seal and a second seal disposed between a hanger and a hanger housing, creating a fixed-volume annular region filled with a first fluid; and a trapped pressure compensator (TPC) disposed in the annular region and filled with a second fluid. The TPC is collapsible from an initial position to a collapsed position in response to a pressure being applied to the outside of the TPC exceeding a predetermined amount. Additionally, the TPC occupies an initial volume in the initial position and a reduced volume in the collapsed position and a fluid pressure in the annular region exceeding the predetermined amount causes the TPC to move from the initial position to the collapsed position. This causes an increase in volume of the annular region such that the fluid pressure in the annular region is below the predetermined amount when the TPC is in the collapsed position.

15 Claims, 3 Drawing Sheets

TRAPPED PRESSURE COMPENSATOR

BACKGROUND

In subsea hydrocarbon drilling operations, a tubing hanger is attached to the topmost tubing joint in the wellhead to support the tubing string. The tubing hanger is typically located in a tubing hanger housing, with both components incorporating a sealing system to ensure that the tubing conduit and annulus are hydraulically isolated.

Seals are used between the tubing hanger and the tubing hanger housing to seal off wellbore pressure. The use of multiple seals forms a fixed-volume annular region between the tubing hanger, the tubing hanger housing, and the seals and does not allow pressure to be released from this region. In some instances, a fluid such as seawater may occupy this annular region. During hydrocarbon production, the temperature of the fluid in the annular region may increase, for example as a result of the increased temperature of the hydrocarbons flowing through the tubing string supported by the tubing hanger. Increasing the temperature of a fluid in a fixed volume can greatly increase the pressure of the fluid. This increase in pressure may challenge the integrity of the annular seals, tubing hanger, or tubing hanger housing.

SUMMARY OF DISCLOSED EMBODIMENTS

In one embodiment, a hanger seal system includes a first seal and a second seal disposed between a hanger and a hanger housing, creating a fixed-volume annular region filled with a first fluid; and a trapped pressure compensator (TPC) disposed in the annular region and filled with a second fluid. The TPC is collapsible from an initial position to a collapsed position in response to a pressure being applied to the outside of the TPC exceeding a predetermined amount. Additionally, the TPC occupies an initial volume in the initial position and a reduced volume in the collapsed position and a fluid pressure in the annular region exceeding the predetermined amount causes the TPC to move from the initial position to the collapsed position. This causes an increase in volume of the annular region such that the fluid pressure in the annular region is below the predetermined amount when the TPC is in the collapsed position.

In another embodiment, a trapped pressure compensator (TPC) includes a hollow body having an interior and an exterior, the interior fluidly sealed from the exterior and filled with a first fluid. The body is collapsible from an initial position to a collapsed position in response to a pressure being applied to the outside of the body exceeding a predetermined amount. Additionally, the body is disposed in a fixed-volume annular region filled with a second fluid and occupies an initial volume in the initial position and a reduced volume in the collapsed position. A fluid pressure in the annular region exceeding the predetermined amount causes the body to move from the initial position to the collapsed position, which causes an increase in volume of the annular region such that the fluid pressure in the annular region is below the predetermined amount when the body is in the collapsed position.

BRIEF DESCRIPTION OF THE DRAWINGS

For a more detailed description of the embodiments, reference will now be made to the following accompanying drawings.

DETAILED DESCRIPTION OF THE DISCLOSED EMBODIMENTS

Figure 1:
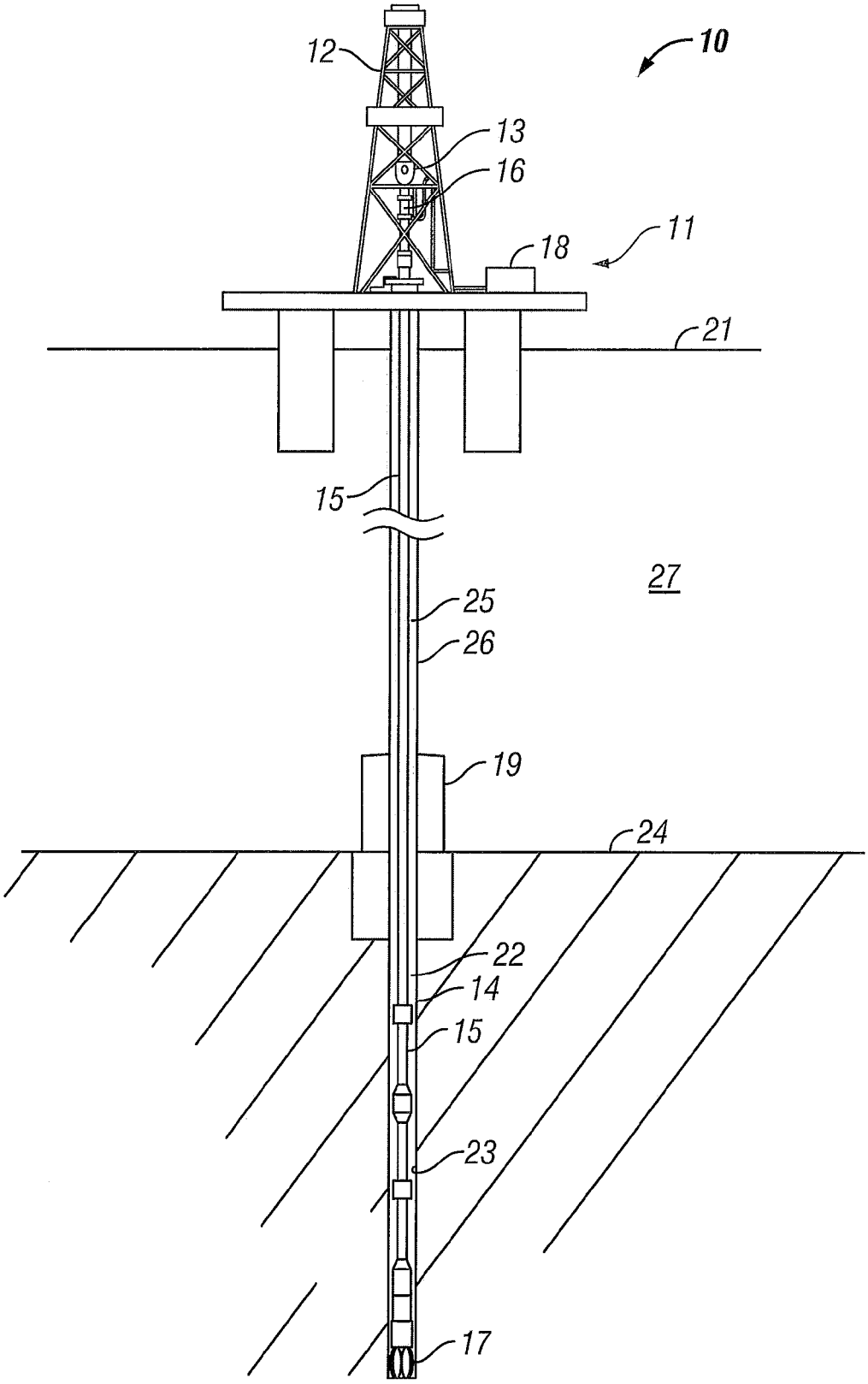
FIG. 1 shows a schematic view of an embodiment of a subsea hydrocarbon well in accordance with various embodiments.

In the drawings and description that follows, like parts are marked throughout the specification and drawings with the same reference numerals. The drawing figures are not necessarily to scale. Certain features of the invention may be shown exaggerated in scale or in somewhat schematic form and some details of conventional elements may not be shown in the interest of clarity and conciseness. The invention is subject to embodiments of different forms. Some specific embodiments are described in detail and are shown in the drawings, with the understanding that the disclosure is to be considered an exemplification of the principles of the invention, and is not intended to limit the invention to the illustrated and described embodiments. The different teachings of the embodiments discussed below may be employed separately or in any suitable combination to produce desired results. The terms connect, engage, couple, attach, or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring now to FIG. 1, a schematic view of an offshore drilling system 10 is shown. Drilling system 10 comprises an offshore drilling platform 11 equipped with a derrick 12 that supports a hoist 13. Drilling of oil and gas wells is carried out by a string of drill pipes connected together by tool joints 14 so as to form a drill string 15 extending subsea from platform 11. The hoist 13 suspends a kelly 16 used to lower the drill string 15. Connected to the lower end of the drill string 15 is a drill bit 17. The bit 17 is rotated by rotating the drill string 15 and/or a downhole motor (e.g., downhole mud motor). Drilling fluid, also referred to as drilling mud, is pumped by mud recirculation equipment 18 (e.g., mud pumps, shakers, etc.) disposed on platform 11. The drilling mud is pumped at a relatively high pressure and volume through the drilling kelly 16 and down the drill string 15 to the drill bit 17. The drilling mud exits the drill bit 17 through nozzles or jets in face of the drill bit 17. The mud then returns to the platform 11 at the sea surface 21 via an annulus 22 between the drill string 15 and the borehole 23, through subsea wellhead 19 at the sea floor 24, and up an annulus 25 between the drill string 15 and a casing 26 extending through the sea 27 from the subsea wellhead 19 to the platform 11. At the sea surface 21, the drilling mud is cleaned and then recirculated by the recirculation equipment 18. The drilling mud is used to cool the drill bit 17, to carry cuttings from the base of the borehole to the platform 11, and to balance the hydrostatic pressure in the rock formations.

Figure 2:
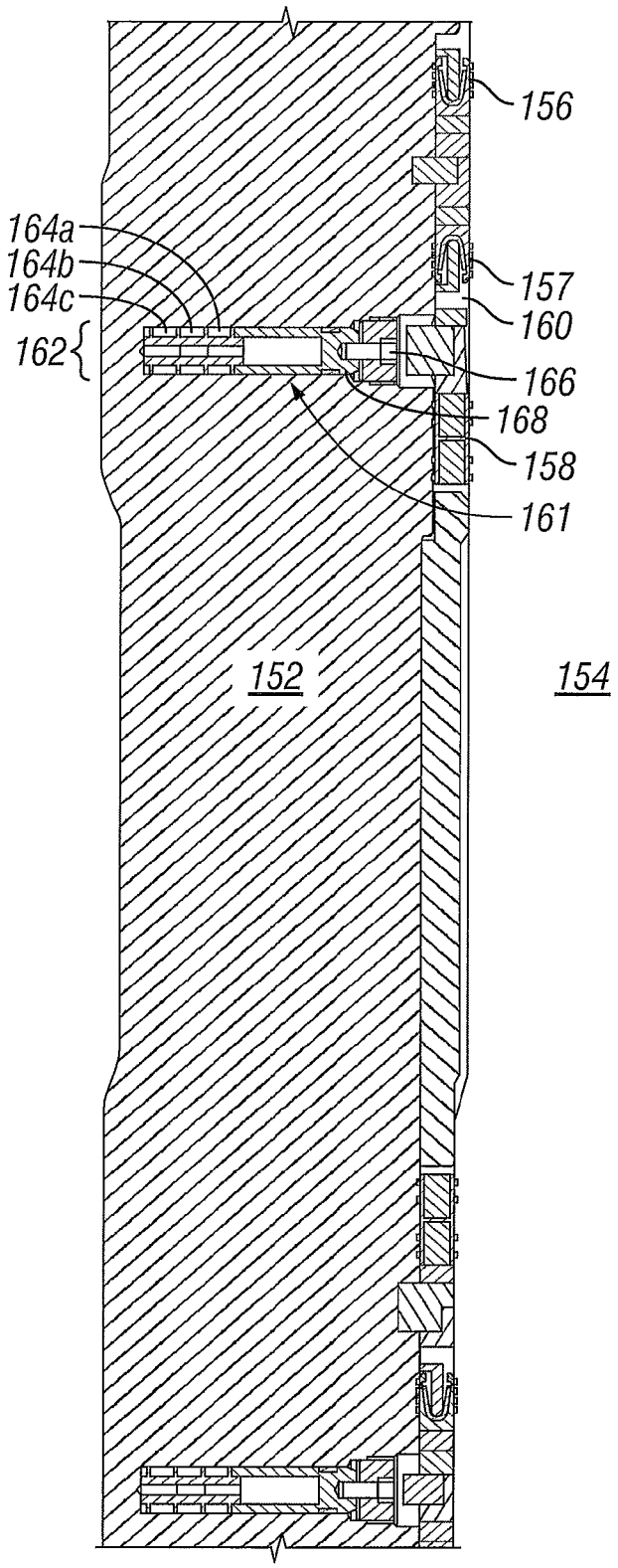
FIG. 2 (Prior Art)
FIG. 2 shows a prior art pressure release mechanism.

FIG. 2 shows a portion of a cross-section of a prior art tubing hanger 152. The tubing hanger 152 may be installed in a tubing hanger housing 154 that is a part of the subsea wellhead 19. One or more seals 156, 157, 158 are installed between the tubing hanger 152 and the tubing hanger housing 154 to seal off wellbore pressure. A fixed-volume annular region 160 is created between two of the seals 157, 158, which may contain a liquid such as seawater or another corrosion-inhibiting liquid. The temperature of the liquid in the annular region 160 may increase, for example during well production, raising the pressure exerted by the liquid on the seals 157, 158 as well as the tubing hanger 152 and the tubing hanger housing 154.

In some instances, a shear disc body 161 is drilled or pressed into the tubing hanger 152. The shear disc body 161 houses one or more shear discs 164*a-c*. When pressure builds in the annular region 160, the pressure applied to a port 166 of the shear disc body 161 also increases. The port 166 enables fluid communication between the annular region 160 and a piston 168. The shear discs 164*a-c* are configured to shear when subjected to a particular pressure, enabling the piston 168 to move radially inward relative to the tubing hanger 152. This effectively lengthens the port 166 and increases the volume of the annular region 160. By increasing the volume of the annular region 160, the pressure of the fluid contained in the annular region 160 is reduced.

The shear disc body 161 occupies a large amount of space due to its width 162, requiring the seals 157, 158 to be farther apart. In some cases, multiple shear disc bodies may be spaced axially along the tubing hanger 152, requiring even more space between the seals 157, 158. Minimizing the space between seals 157, 158 minimizes the form factor required to join the tubing hanger 152 to the tubing hanger housing 154. Additionally, less time and cost would be needed if the shear disc body 161 and other similar shear disc bodies were easier to install.

Figure 3:
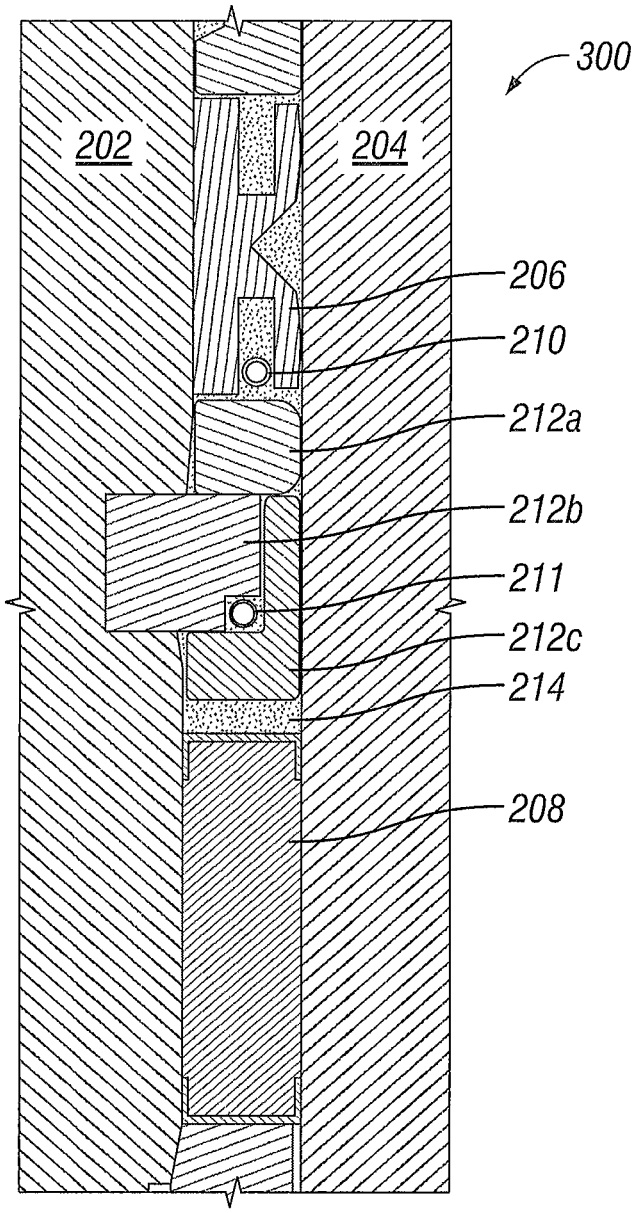
FIG. 3 shows a trapped pressure compensator in accordance with various embodiments.

FIG. 3 shows a tubing hanger seal system 300 in accordance with various embodiments. The tubing hanger seal system 300 comprises seals 206, 208 between a tubing hanger 202 and a tubing hanger housing 204 to seal off wellbore pressure. In some embodiments, the seal 206 comprises a K-shaped metal-to-metal seal and the seal 208 comprises a rubber seal. The tubing hanger 202 is installed in the tubing hanger housing 204, which may be a part of the subsea wellhead 19. One or more mechanical load shoulders 212*a-c* are coupled to the tubing hanger 202 to prevent the seals 206, 208 from translating up or down in the region between the tubing hanger 202 and the tubing hanger housing 204.

A fixed-volume annular region 214 is created between the seals 206, 208. The annular region 214 contains a liquid, such as seawater or a corrosion-inhibiting liquid. When the well is producing, the tubing string (not shown) supported by the tubing hanger 202 increases in temperature, causing a resulting increase in temperature of the tubing hanger 202 and the liquid in the annular region 214. The increase in temperature of the liquid in the annular region 214 causes a corresponding increase in pressure exerted by the liquid on the seals 206, 208; the tubing hanger 202; and the tubing hanger housing 204.

In accordance with various embodiments, a trapped pressure compensator (TPC) 210 is provided in the annular region 214. The TPC 210 may be a collapsible, hollow ring composed of, for example, a deformable metal such as stainless steel or Inconel™. The TPC 210 is in an initial position before collapsing and in a collapsed position after collapsing. In some embodiments, the TPC 210 is filled with a gas (e.g., nitrogen, helium, or oxygen), which facilitates compression of or collapsing of the TPC 210. Although the TPC 210 is shown as having a circular cross-section, one skilled in the art appreciates that the cross-section of the TPC 210 may have a different geometric shape, such as an oval. Additionally, the TPC 210 is shown fitting between legs of the seal 206; however, the TPC 210 could be positioned elsewhere in the annular region 214, such as between load shoulders 212*b* and 212*c* (e.g., TPC 211) or below mechanical load shoulder 212*c* (not shown).

As explained above, the temperature of a liquid in the annular region 214 may increase in response to producing hydrocarbons through the tubing string (not shown). This causes the pressure exerted by the liquid to increase as well. However, because the TPC 210 is filled with a gas, the liquid pressure in the annular region 214 increases faster than the gas pressure in the TPC 210 for a given increase in temperature. The TPC 210 is constructed of a material designed such that the increased fluid pressure in the annular region 214 collapses the internal volume of the TPC 210 when the liquid pressure exceeds a predetermined amount determined based on the construction of the tubing hanger 202, the tubing hanger housing 204, and the seals 206, 208 (i.e., when the liquid pressure exceeds the design pressure of the installed equipment). The TPC 210 collapsing causes an increase in the volume of the annular region 214 and a corresponding reduction in pressure of the liquid in the annular region 214. In accordance with various embodiments, the reduction in liquid pressure in the annular region 214 causes the liquid pressure to be below the predetermined amount.

In some embodiments, multiple TPCs 210, 211 may be installed between the seals 206, 208 to enable a greater increase in volume—and corresponding reduction in liquid pressure in the annular region 214—when the TPCs 210, 211 collapse. Additionally, the TPCs 210, 211 may be constructed to collapse at differing pressure levels such that the collapse of TPCs 210, 211 is staggered as the liquid pressure in the annular region 214 increases. Furthermore, although explained as being a ring, the TPC 210 could be a hollow tube that does not extend completely around the circumference of the tubing hanger 202.

In accordance with various embodiments, the TPC 210 provides a cost-effective solution to correct for rising pressure in a fixed volume between two seals 206, 208. Additionally, the TPC 210 does not require drilling or any modification of the tubing hanger 202. Furthermore, the TPC 210 may easily fit into or in between pre-existing elements (e.g., seals 206, 208; mechanical load shoulders 212*a-c*) and thus has a smaller form factor than the shear disc bodies described in FIG. 2.

While specific embodiments have been shown and described, modifications can be made by one skilled in the art without departing from the spirit or teaching of this invention. The embodiments as described are exemplary only and are not limiting. Many variations and modifications are possible and are within the scope of the invention. For example, although described primarily with respect to an annular region between a tubing hanger and a tubing hanger housing, a TPC could be used in any fixed-volume annular region between two seals and with any type of hanger. Accordingly, the scope of protection is not limited to the embodiments described, but is only limited by the claims that follow, the scope of which shall include all equivalents of the subject matter of the claims.

What is claimed is:

1. A hanger seal system, comprising:

a first seal and a second seal disposed between a hanger and a hanger housing, creating an annular region filled with a first fluid; and a trapped pressure compensator (TPC) disposed in the annular region and filled with a second fluid, the TPC comprising a hollow body defining an outer profile of the TPC, wherein the hollow body is collapsible from an initial position to a collapsed position in response to a pressure in the annular region being applied to the outside of the TPC exceeding a predetermined amount;

wherein the hollow body occupies an initial volume in the initial position and a reduced volume in the collapsed position; and wherein when the hollow body is in the collapsed position, the pressure in the annular region is lowered and the volume in the annular region is increased.

2. The hanger seal system of claim 1 wherein the first fluid is denser than the second fluid such that the fluid pressure of the first fluid is greater than the fluid pressure of the second fluid for an increase in temperature of the first and second fluids.

3. The hanger seal system of claim 1 wherein the TPC is a hollow ring disposed circumferentially around the hanger in the annular region.

4. The hanger seal system of claim 1 wherein the TPC is a hollow tube disposed in the annular region.

5. The hanger seal system of claim 1 further comprising more than one TPC.

6. The hanger seal system of claim 5 wherein the other TPC is collapsible from an initial position to a collapsed position in response to a pressure greater than the predetermined amount being applied to the outside of the other TPC.

7. The hanger seal system of claim 5 wherein the other TPC is collapsible from an initial position to a collapsed position in response to a fluid pressure in the annular region exceeding the predetermined amount being applied to the outside of the other TPC.

8. The hanger seal system of claim 1 wherein the TPC comprises a circular cross-section.

9. The hanger seal system of claim 1 wherein the TPC comprises an oval cross-section.

10. A trapped pressure compensator (TPC) locatable in an annular region, comprising:

A hollow body disposed within the annular region, the hollow body defining an outer profile of the TPC;

wherein the hollow body is collapsible from an initial position to a collapsed position in response to a fluid pressure in the annular region being applied to the outside of the hollow body exceeding a predetermined amount;

wherein the hollow body occupies an initial volume in the initial position and a reduced volume in the collapsed position; and wherein when the hollow body moves from the initial position to the collapsed position, the volume of the annular region is increased and the fluid pressure in the annular region is lowered.

11. The TPC of claim 10 wherein the body is a hollow ring disposed around a hanger in the annular region.

12. The TPC of claim 10 wherein the body is a hollow tube.

13. The TPC of claim 10 wherein the body comprises a circular cross-section.

14. The TPC of claim 10 wherein the body comprises an oval cross-section.

15. The TPC of claim 10 wherein the hollow body extends completely around the annular region.

* * * * *